US006336781B1

(12) United States Patent
Doppelmayr et al.

(10) Patent No.: US 6,336,781 B1
(45) Date of Patent: Jan. 8, 2002

(54) INSTALLATION FOR PARKING MOTOR VEHICLES IN A SPACE-SAVING MANNER

(75) Inventors: Michael Doppelmayr, Wolfurt; Peter Malin, Bregenz, both of (AT)

(73) Assignee: Lagertechnik Gesellschaft m.b.H., Wolfurt (AT)

( * ) Notice: Subject to any disclaimer, the term of this patent is extended or adjusted under 35 U.S.C. 154(b) by 0 days.

(21) Appl. No.: 09/380,655

(22) PCT Filed: Mar. 6, 1998

(86) PCT No.: PCT/AT98/00054

§ 371 Date: Oct. 8, 1999

§ 102(e) Date: Oct. 8, 1999

(87) PCT Pub. No.: WO98/39536

PCT Pub. Date: Sep. 11, 1998

(30) Foreign Application Priority Data

Mar. 6, 1997 (AT) ..... 382/97

(51) Int. Cl.[7] ..... E04H 6/12

(52) U.S. Cl. ..... 414/253; 414/260; 414/261; 414/264

(58) Field of Search ..... 414/234, 239, 414/253, 254, 255, 256, 259, 260, 261, 262, 263, 264, 286, 331.05, 331.11

(56) References Cited

U.S. PATENT DOCUMENTS

| | | | | | |
|---|---|---|---|---|---|
| 1,614,905 | A | * | 1/1927 | Tunison | 414/263 X |
| 1,849,470 | A | * | 3/1932 | Wheelock | 414/262 X |
| 4,166,546 | A | * | 9/1979 | English | 414/263 |
| 4,936,730 | A | * | 6/1990 | Morioka | 414/239 |
| 4,941,794 | A | * | 7/1990 | Hara et al. | 414/275 |
| 4,998,856 | A | * | 3/1991 | LaBarre | 414/263 X |
| 5,116,182 | A | * | 5/1992 | Lin | 414/254 |
| 5,118,239 | A | * | 6/1992 | Morioka | 414/239 X |
| 5,243,796 | A | * | 9/1993 | Casini | 414/256 X |
| 5,314,284 | A | * | 5/1994 | Tsai | 414/234 |
| 5,333,987 | A | * | 8/1994 | Takaoka | 414/261 X |
| 5,460,470 | A | | 10/1995 | Wilson | |
| 5,467,561 | A | * | 11/1995 | Takaoka | 414/239 X |
| 5,868,540 | A | * | 2/1999 | Hirose et al. | 414/241 X |
| 5,915,907 | A | * | 6/1999 | Yatou et al. | 414/261 X |
| 5,980,185 | A | * | 11/1999 | Vita | 414/256 |

FOREIGN PATENT DOCUMENTS

| | | | | |
|---|---|---|---|---|
| DE | 38 38218 | | 5/1990 | |
| EP | 0 306 058 | | 3/1989 | |
| EP | 0 604 818 | | 7/1994 | |
| JP | 35173 | * | 2/1990 | 414/234 |
| JP | 3208970 | * | 9/1991 | 414/234 |
| JP | 4353174 | * | 12/1992 | 414/239 |
| JP | 4353175 | * | 12/1992 | 414/239 |
| WO | 91/16515 | | 10/1991 | |

* cited by examiner

*Primary Examiner*—James W. Keenan
(74) *Attorney, Agent, or Firm*—Wenderoth, Lind & Ponack, L.L.P.

(57) ABSTRACT

The invention relates to an installation for parking motor vehicles (5) in a space-saving manner, having a plurality of parking spaces (2) arranged on top of each other and designed to hold the motor vehicles (5). The invention provides for a lifting device (3) for transporting the motor vehicles (5) to the individual parking spaces (2), the lifting device being mounted on a turntable (8). In addition, the lifting device (3) can be horizontally displaced on the turntable (8).

21 Claims, 11 Drawing Sheets

Fig. 4
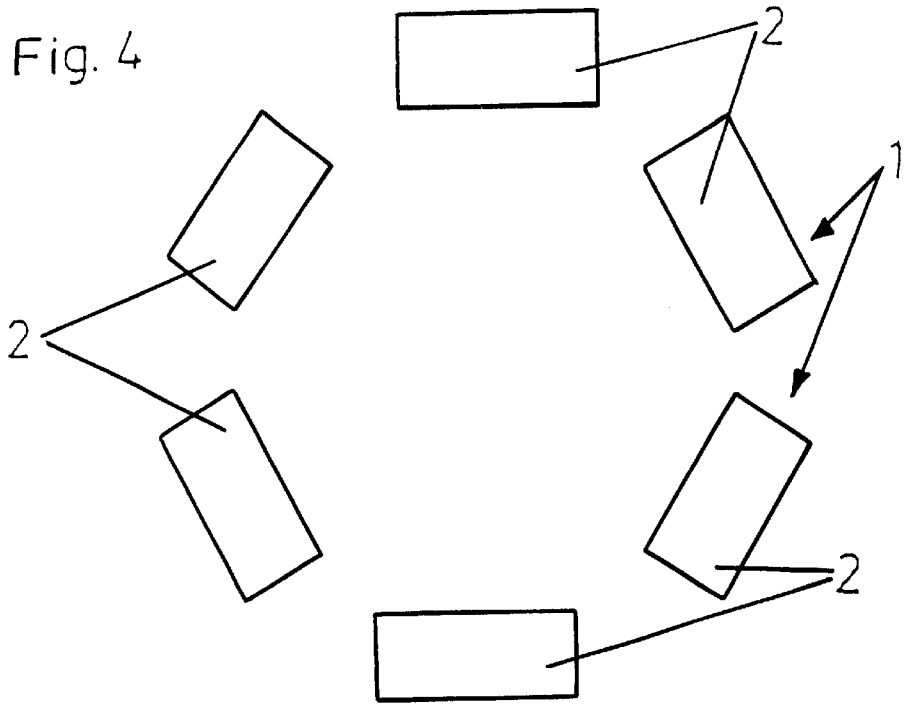
Fig. 12a
Fig. 12b
Fig. 12c
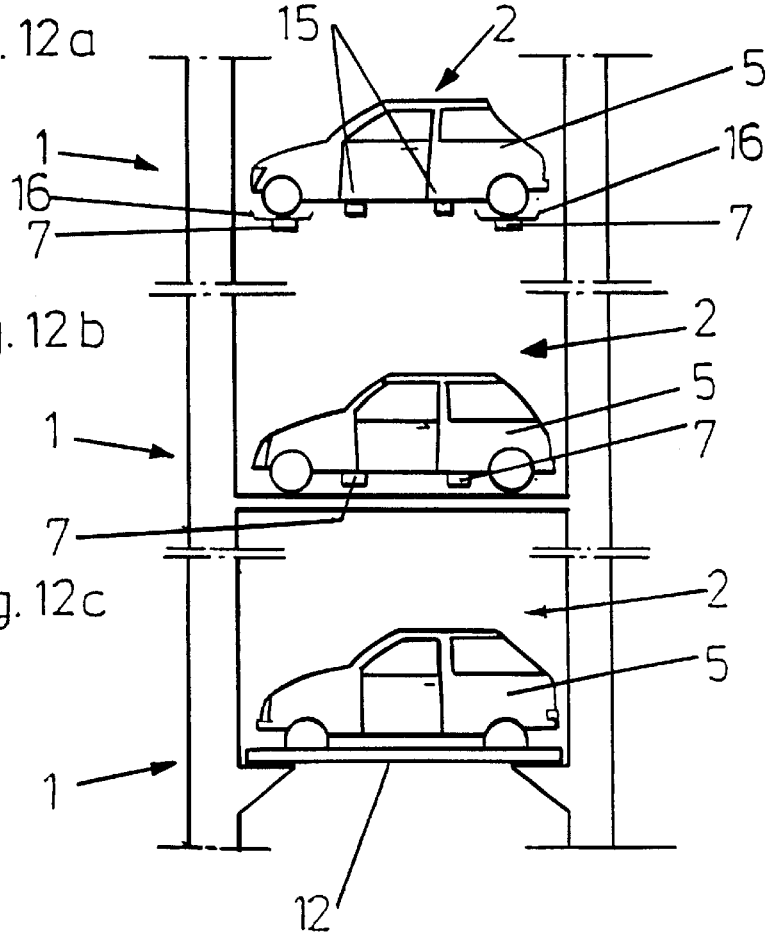

INSTALLATION FOR PARKING MOTOR VEHICLES IN A SPACE-SAVING MANNER

FIELD OF THE INVENTION

The invention relates to an installation for parking motor vehicles in a space-saving manner in parking spaces arranged one above the other, with a lifting tower rotatable about a vertical axis for transporting the motor vehicles to the individual parking spaces, a horizontal transport device and a turning device for the lifting tower.

DESCRIPTION OF THE RELATED ART

Parking garages are known, in which vehicles go to the parking spaces by way of ramps and roadways. Also known are multi-level systems having parking spaces arranged on a plurality of storeys and with at least one vertically displaceable inter-storey conveyor for transporting the motor vehicle from one storey to another. In this system, the individual motor vehicles can be set down on pallets. Transport installations are also known in which the motor vehicles can be transported horizontally.

DE-B 38 30 136 discloses a parking building for motor vehicles having a central elevator. The elevator has a rotatable tower provided with a rotary support structure. The rotary support structure is part of the tower. Maneuvering devices are also provided for displacing the vehicles horizontally.

SUMMARY OF THE INVENTION

The object of the present invention is to improve on installations of the kind set forth above, in such a way that the surface area requirement of the parking building can be kept small with a maximum number of parking spaces. The object of the invention is attained in that the turning device is formed by a turntable which is separate from a lifting tower, the lifting tower being horizontally displaceable on the turntable.

In this case, the turntable may be arranged so that it is stationary or it may be displaceable by its own traveling chassis arrangement, for example, a shelf operating assembly. It is preferably provided that a lifting fork is displaceable on the lifting tower.

In order to improve the stability of the lifting device, a support roller is advantageously provided at an end of the chassis arrangement remote from the lifting tower. In order to facilitate unloading of the motor vehicles in the respective lowermost parking spaces, it is advantageously provided that the lowermost parking spaces have a base whose height corresponds to the height of the turning device.

A further embodiment of the invention provides that the lifting tower is telescopically extendable.

BRIEF DESCRIPTION OF THE DRAWINGS

Embodiments of the invention are described hereinafter with reference to the Figures of the drawings.

FIG. 4 is a diagrammatic view showing the arrangement of the parking spaces.

FIGS. 12a-c are side views of parking spaces arranged in mutually superposed relationship. Illustrating various support configurations for the motor vehicles.

DETAILED DESCRIPTION OF THE INVENTION

Figure 1:
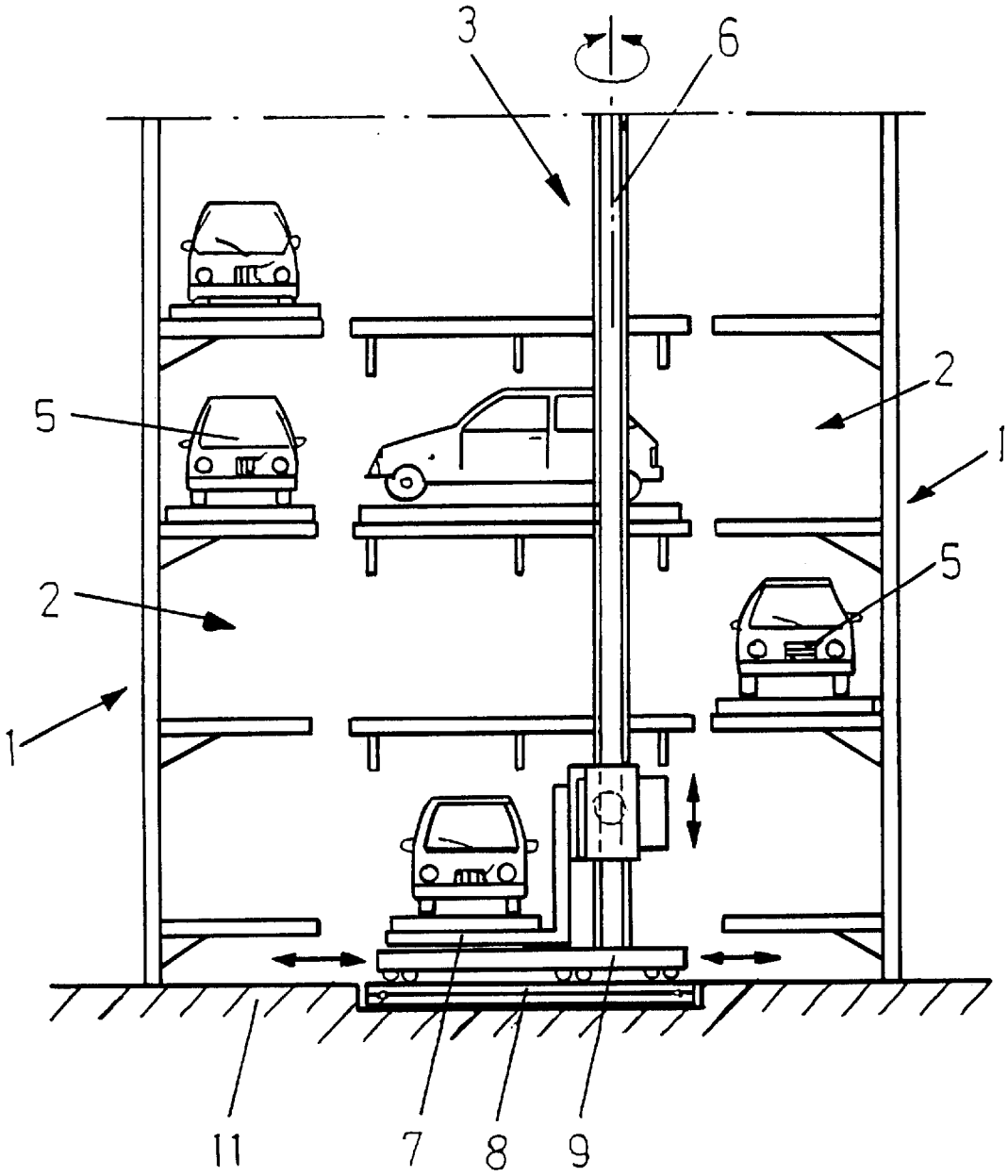
FIG. 1 is a diagrammatic elevational view of an installation according to the invention.

The installation according to the invention comprises at least two vertical rows 1 of parking spaces 2 arranged in mutually superposed relationship and a lifting device 3. The embodiment shown in FIG. 3 has three rows 1 of parking spaces 2 arranged in vertically mutually superposed relationship. It would however also be readily possible to provide a fourth row 1, in which case a region, (door opening) 14 is left free only at the first floor level to permit the motor vehicles 5 to go to the lifting device 3.

The lifting device 3 has a lifting tower (mast) 6 on which a lifting fork 7 is vertically displaceable. The lifting tower 6 is arranged on a turntable 8. The turntable 8 is provided with a rotary track ring and can be turned through 360°.

Figure 14:
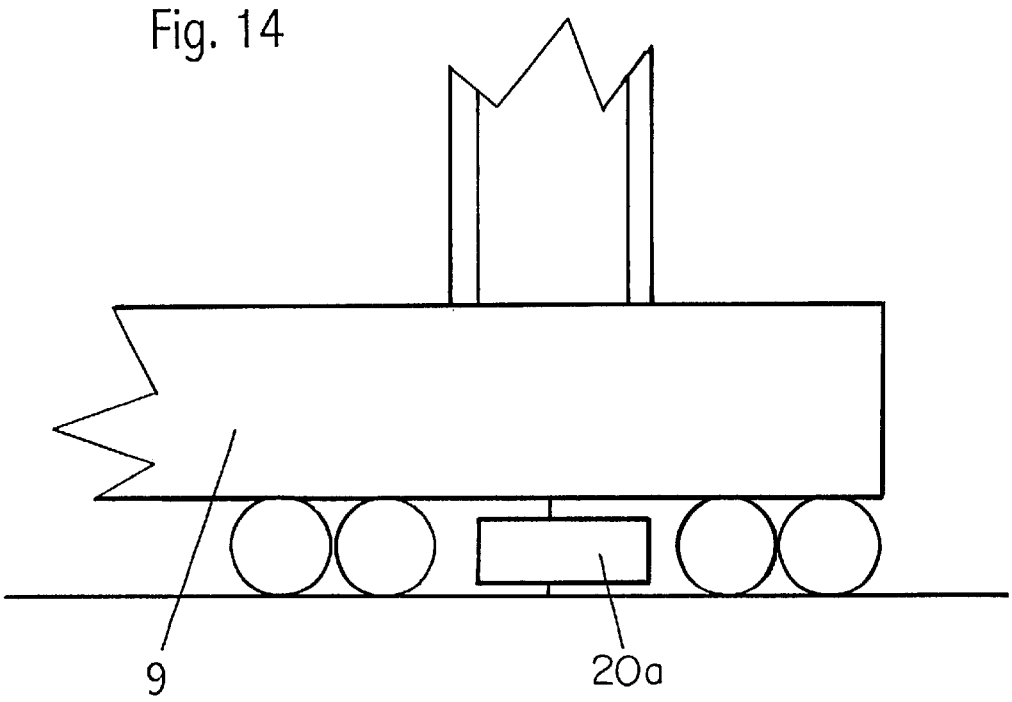
FIGS. 14-17 are schematic illustrations of horizontal displacement drives.
Figure 15:
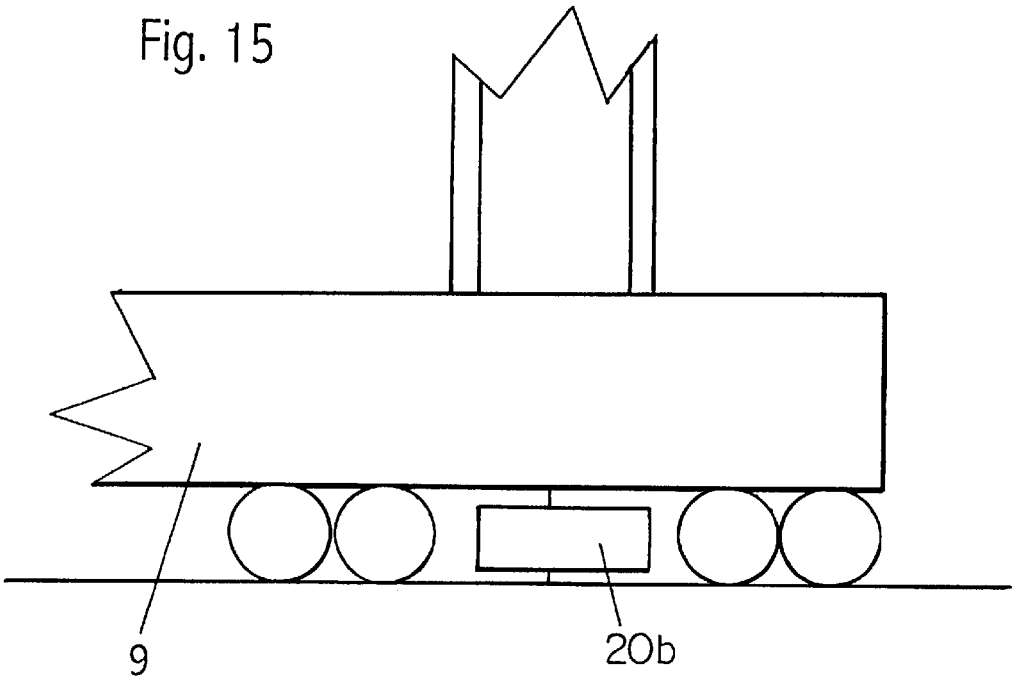
Figure 16:
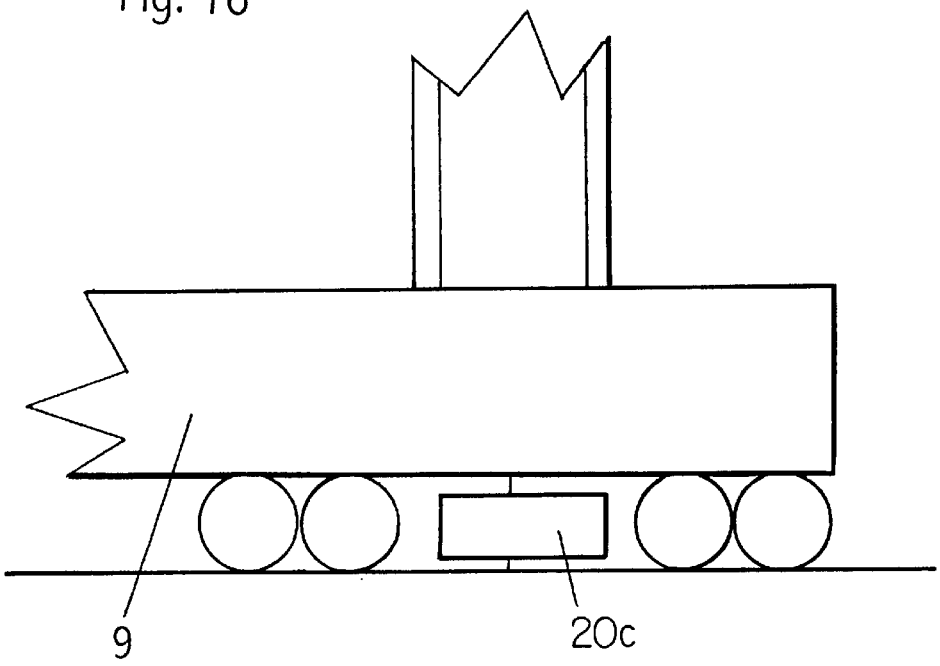
Figure 17:
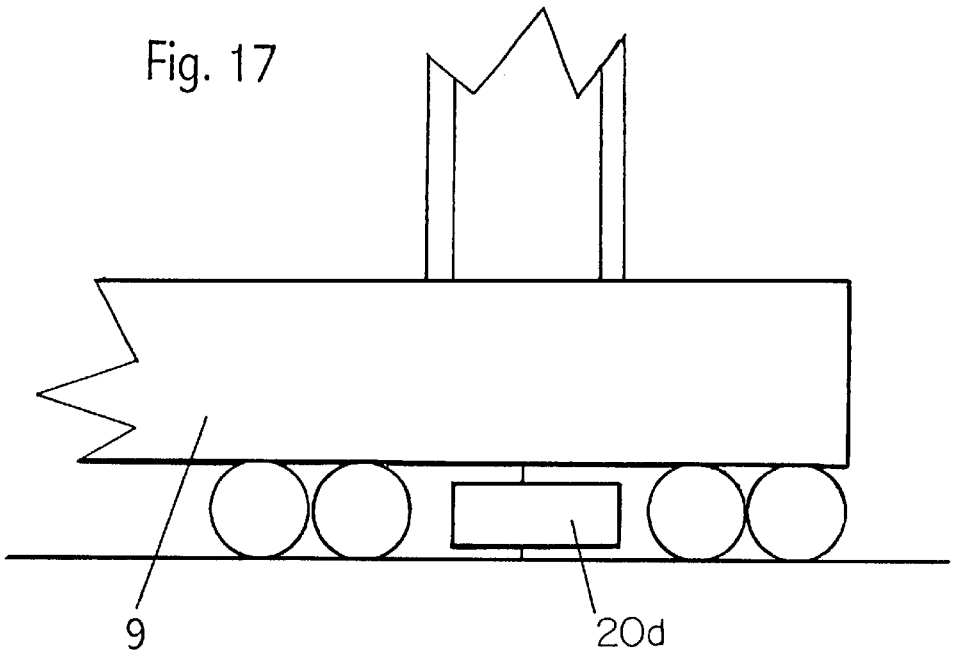

The lifting tower 6 has a traveling chassis arrangement 9 which is provided at its free end with a support roller 10. The lifting device 3 or the traveling chassis arrangement 9 thereof is mechanically connected to the turntable 8. Horizontal displacement of the lifting device via a horizontal transport device is advantageously effected by way of a spindle drive 20*a* (FIG. 14) or a toothed rack drive 20*b*(FIG. 15). It is however also possible to use a hydraulic drive 20*c* (FIG. 16) or pneumatic drive 20*d*(FIG. 17) for the horizontal transport device. The drive for the spindle drive or the toothed rack drive is afforded by way of electric motors, preferably servomotors.

Figure 2:
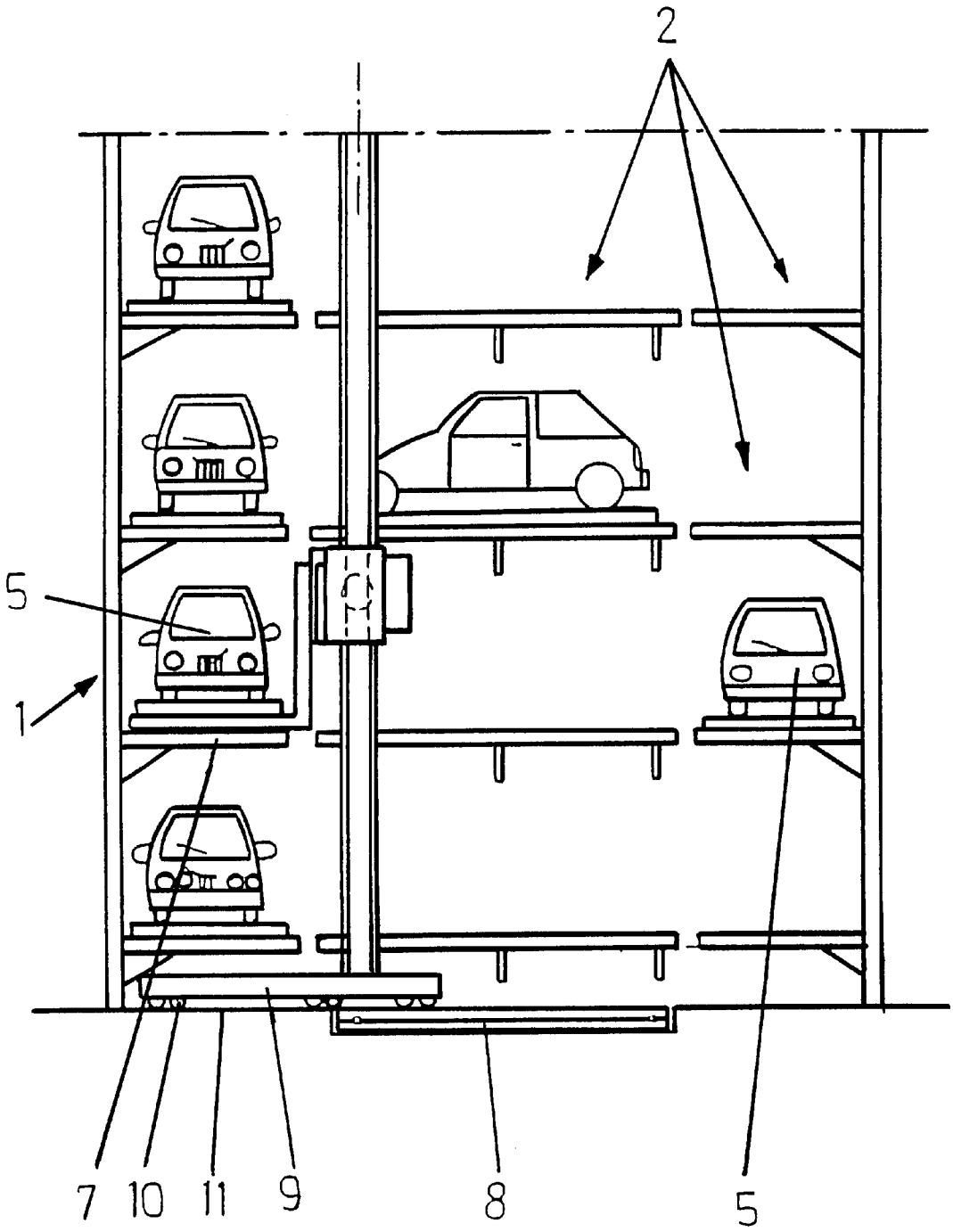
FIG. 2 shows an elevational view of the lifting device when delivering a motor vehicle to a parking space.

Provided below the parking spaces 2 of the lowermost row 1 is a base 11, the height of which corresponds to the height of the turntable 8, so that the traveling chassis arrangement 9 can be moved from the receiving position for the motor vehicle 5, as shown in FIG. 1, into the delivery position shown in FIG. 2 at the parking space 2.

The feed of motor vehicles 5 is effected as described hereinafter. The motor vehicle 5 drives onto two drive-on channels 12 or a drive-on pallet which rests on the lifting fork 7 of the lifting device 3. The turntable 8 with the lifting mast 6 is then turned until the motor vehicle 5 is oriented in the desired direction. Thereupon the motor vehicle 5 is raised by means of the lifting fork 7 and moved to the desired parking space 2.

Figure 10:
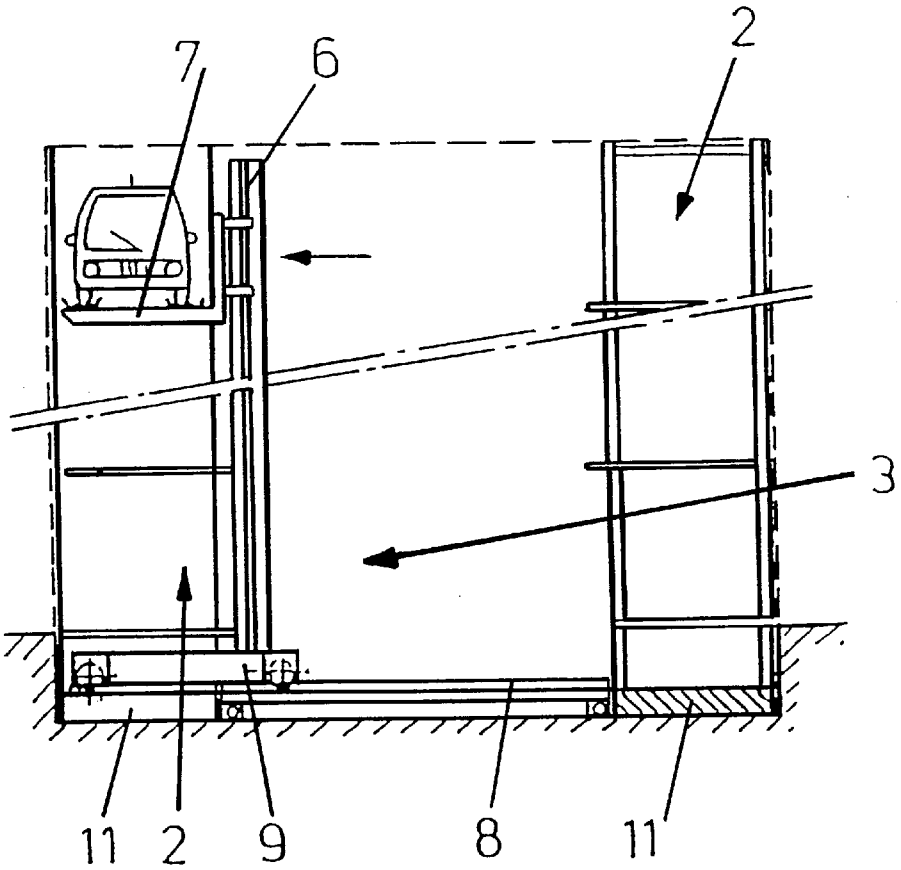
Figure 9:
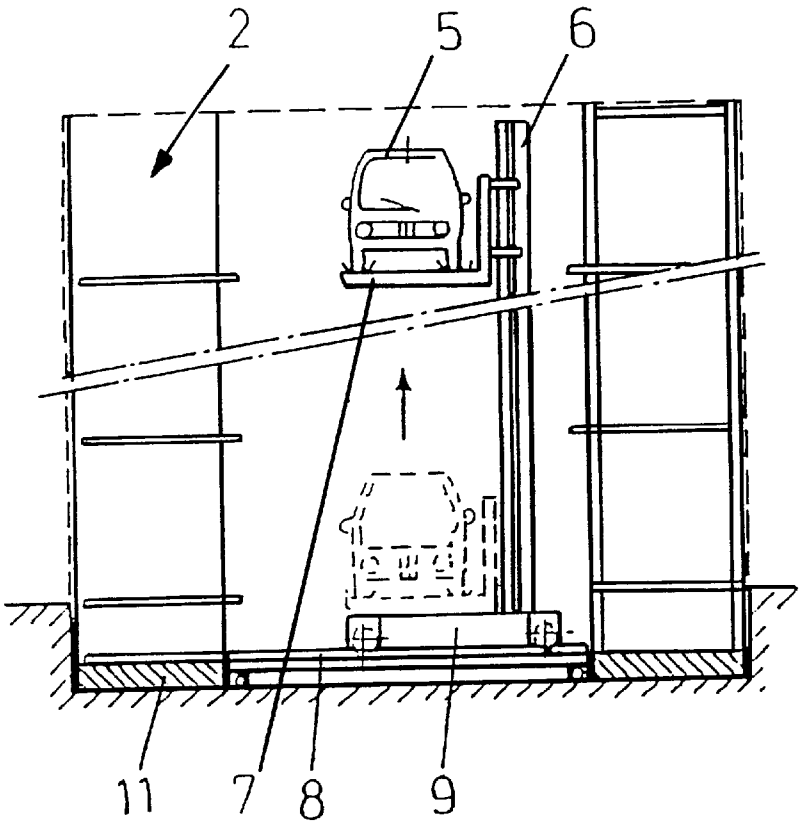
Figure 11:
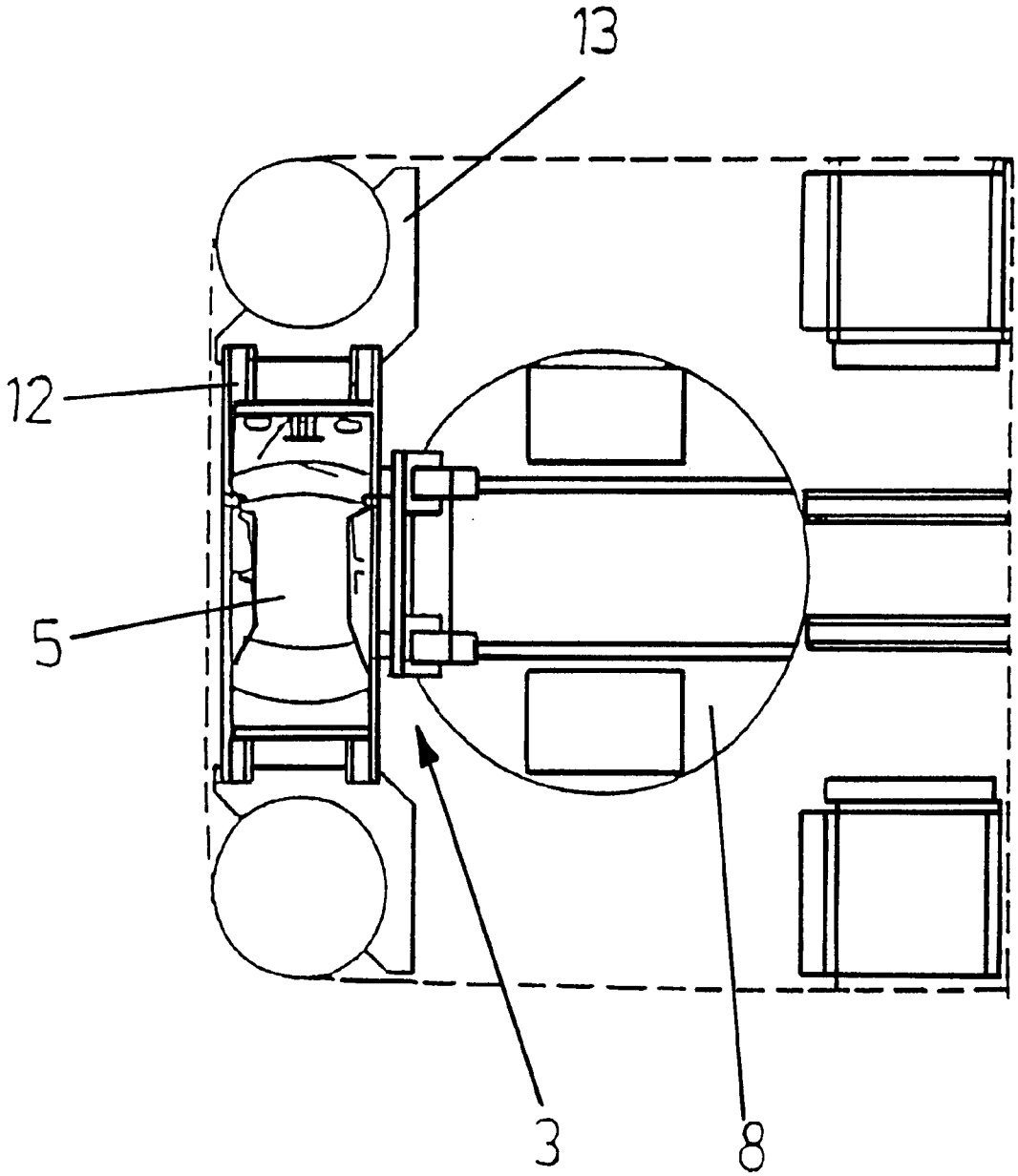

When the desired height is reached, the lifting mast 6 with the traveling chassis arrangement 9 is moved into the position shown in FIGS. 10 and 11. The drive-on channels 12 are put down onto shelf profile members 13 and thus the motor vehicle 5 is stored at the parking space. It is also possible to provide pallets instead of the drive-on channels 12. In principle it would also be possible for the motor vehicle 5 firstly to be raised to the desired storey and then for the lifting device 3 to be turned.

Figure 6:
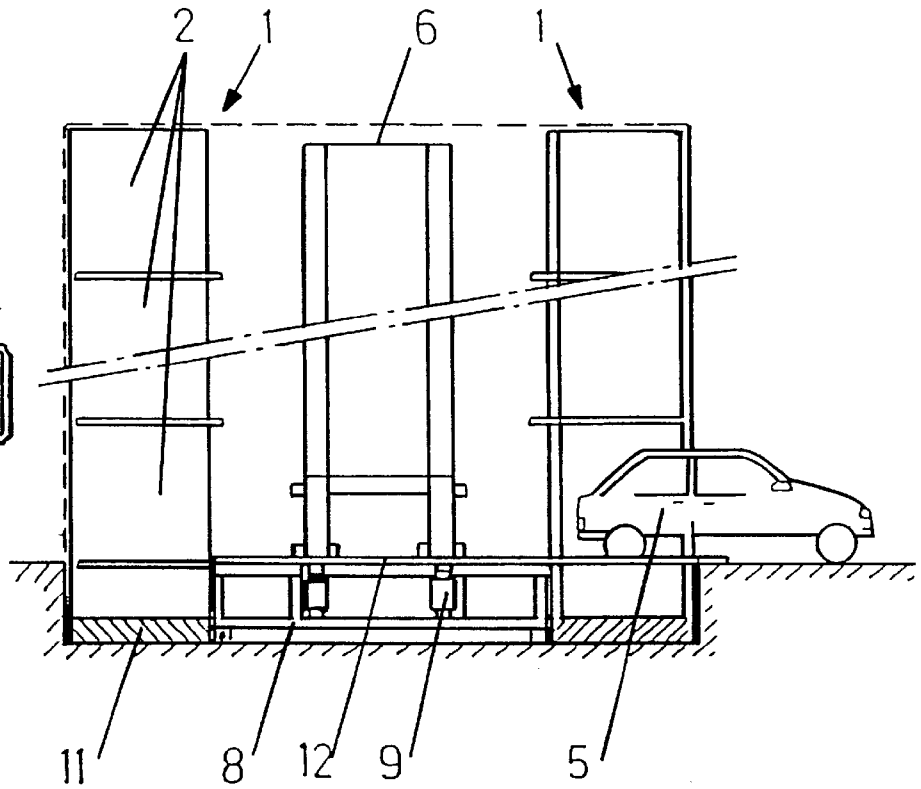
FIGS. 5 through 11 show plan and elevational views of the various stages in vehicle-transfer and discharge.
Figure 5:
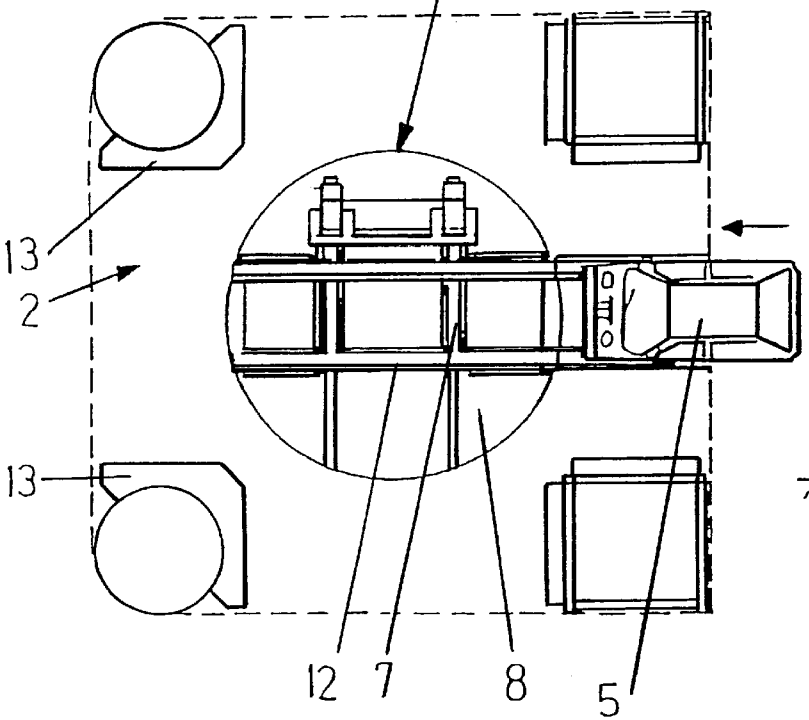
Figure 8:
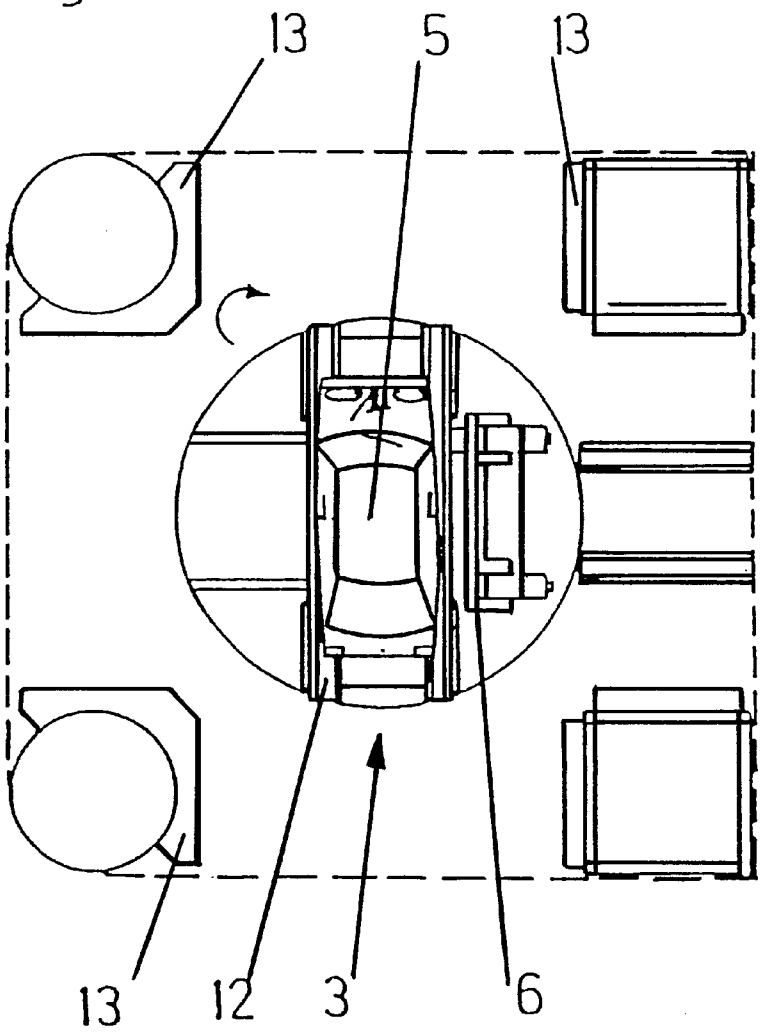
Figure 7:
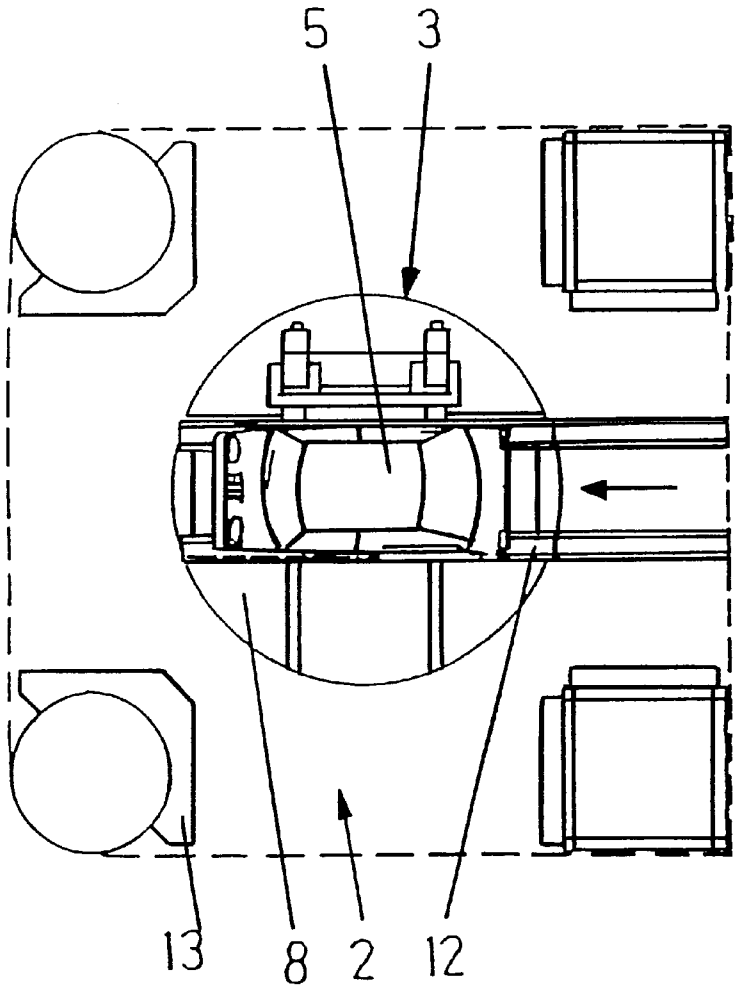

The lifting device 3 moves back again into its central receiving position shown in FIGS. 5, 6 and 7 and the lifting fork 7 is oriented with respect to the door opening 14.

The reversed procedure is involved in fetching each motor vehicle 5 from its parking space 2. Storage of the motor vehicle 5 does not have to be effected by way of drive-on channels 12 or by way of a drive-on pallet. The parking spaces 2 can also be in the form of cantilever-arm shelf assemblies 15.

In this case, the motor vehicle 5 is lifted by channels 16 which are mounted on the lifting fork 7 and which are oriented transversely with respect to the longitudinal axis of the vehicle and on which it rests with its wheels (see FIG. 12*a*). After the desired parking space 2 is reached the motor vehicle is set down with the chassis thereof directly onto the cantilever arms 15.

Figure 3:
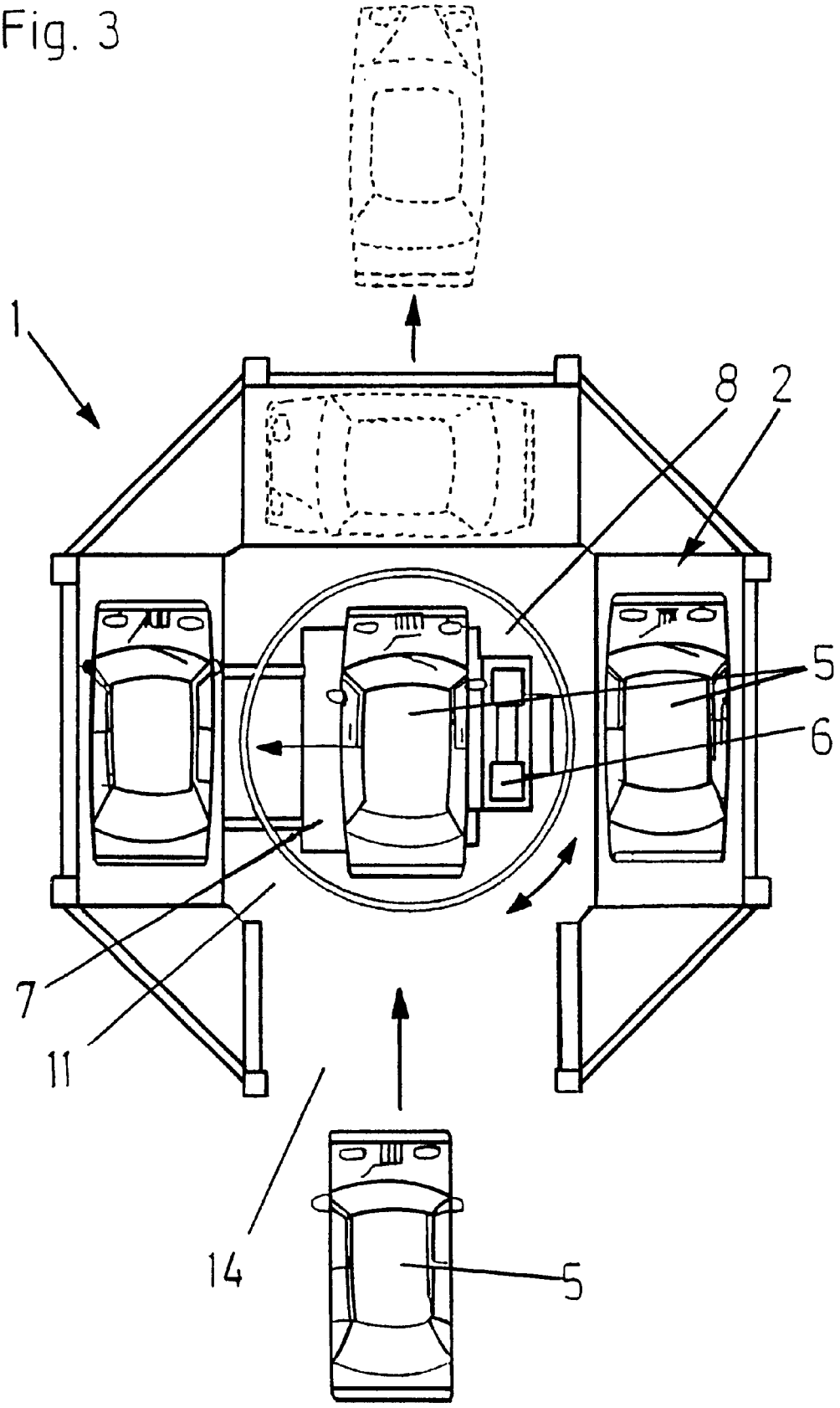
FIG. 3 shows a plan view of the installation.
Figure 13:
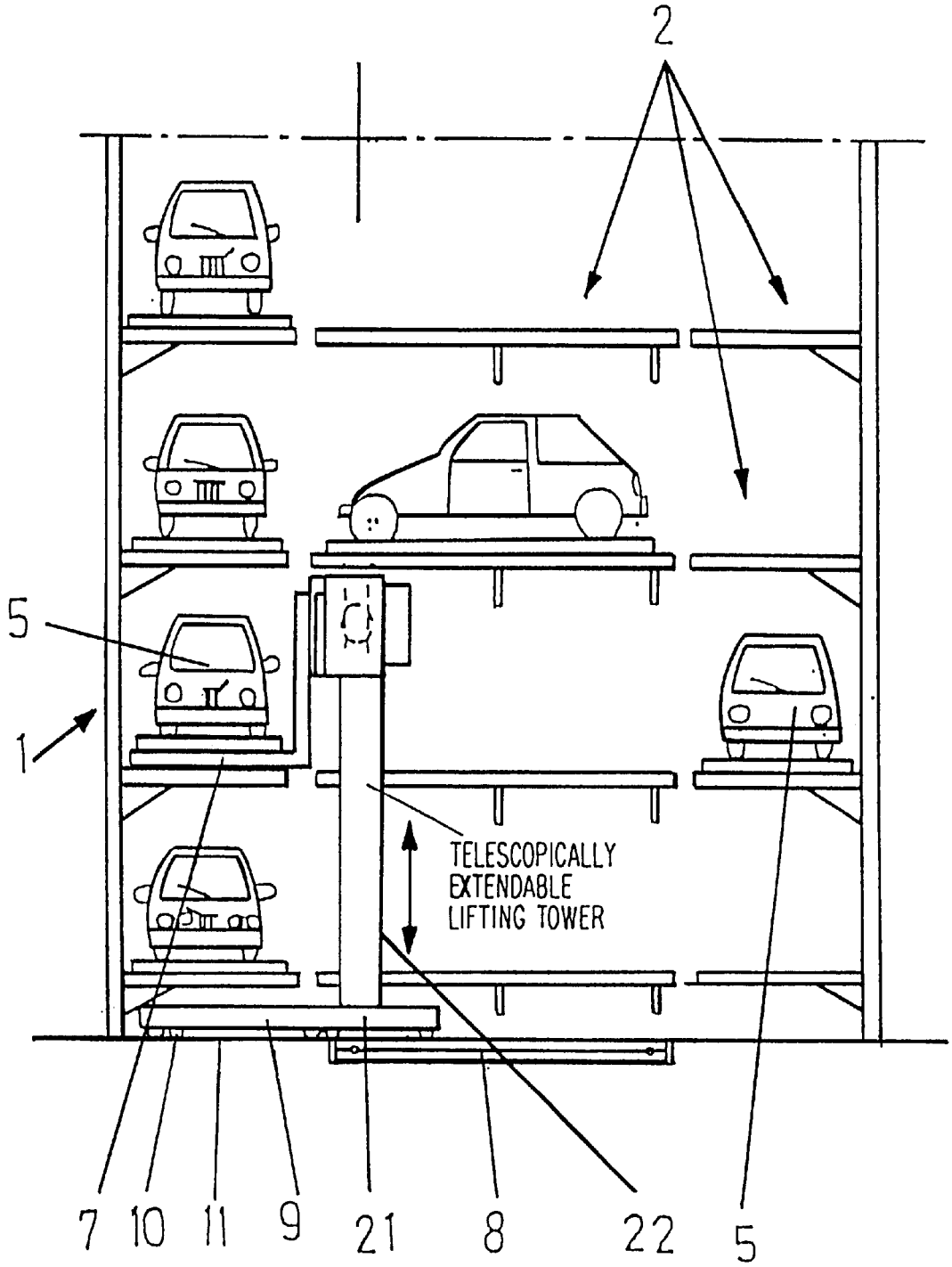
FIG. 13 is a diagrammic view of a second embodiment of an installation according to the invention.

The installation according to the invention is preferably provided with three or four vertical rows 1 of parking spaces 2 arranged in mutually superposed relationship, as shown in FIG. 3. It is however also possible for the turntable 8 to be arranged with its drive on its own traveling chassis arrangement so that the lifting device 3 is displaceable, in a similar manner to a high-level shelf in a movable shelf assembly. It is likewise possible, as shown in FIG. 4, to provide more than four rows 1 of parking spaces 2 which can be served by the lifting device. In that case, the rows 1 are arranged substantially in a polygonal array. It is further possible, as shown in FIG. 13, to have a lifting device 21 with a telescopically extendable lifting tower 22 to lift the vehicle 5.

What is claimed is:

1. An installation for parking motor vehicles in a space-saving manner, said installation comprising:

at least two parking levels, wherein each of said at least two parking levels comprises at least one parking space;

a turning device comprising a turntable operable to rotate about an axis; and a lifting device moveably located on said turntable and operable to transport the motor vehicles to said parking spaces, said lifting device comprising:

a lifting tower, a lifting fork moveably connected to said lifting tower, wherein said lifting fork is vertically displaceable along said lifting tower, and a traveling chassis connected in an asymmetrical arrangement to said lifting tower, said traveling chassis operable to move said lifting device horizontally, wherein said lifting tower is rotatable about the axis via said turning device and is horizontally displaceable on said turntable via said traveling chassis.

2. An installation as set forth in claim 1, wherein said traveling chassis comprises one of a toothed rack drive and a spindle drive.

3. An installation as set forth in claim 1, wherein said traveling chassis comprises one of a hydraulic drive and a pneumatic drive.

4. An installation as set forth in claim 1, wherein said traveling chassis and said lifting fork extend from said lifting tower in a substantially same direction for a substantially same distance.

5. An installation as set forth in claim 1, wherein said traveling chassis comprises a support roller located at an end of said traveling chassis that is remote from said lifting tower.

6. An installation as set forth in claim 1, wherein said turning device has a height corresponding to a height of a base located below at least one parking space of a lowermost parking level of said at least two parking levels.

7. An installation as set forth in claim 1, wherein at least one of said parking spaces comprises cantilever arms operable to support a motor vehicle.

8. An installation as set forth in claim 1, wherein said lifting fork is operable to use channel-shape rails to transport the motor vehicles to said parking spaces and at least one of said parking spaces comprises shelf profile members operable to support the channel-shape rails and the motor vehicle.

9. An installation as set forth in claim 1, wherein said lifting fork is operable to use pallets to transport the motor vehicles to said parking spaces and at least one of said parking spaces comprises shelf profile members operable to support a pallet and the motor vehicle.

10. An installation as set forth in claim 1, wherein each of said at least two parking levels comprises a plurality of parking spaces arranged in a polygon around said lifting device.

11. An installation for parking motor vehicles in a space-saving manner, said installation comprising:

at least two parking levels, wherein each of said at least two parking levels comprises at least one parking space;

a turning device comprising a turntable operable to rotate about an axis; and a lifting device moveably located on said turntable and operable to transport the motor vehicles to said parking spaces, said lifting device comprising:

a telescopically extendable lifting tower, a lifting fork connected to said telescopically extendable lifting tower, and a traveling chassis connected in an asymmetrical arrangement to said telescopically extendable lifting tower, said traveling chassis operable to move said lifting device horizontally, wherein said telescopically extendable lifting tower is rotatable about the axis via said turning device and is horizontally displaceable on said turntable via said traveling chassis.

12. An installation as set forth in claim 11, wherein said traveling chassis comprises one of a toothed rack drive and a spindle drive.

13. An installation as set forth in claim 11, wherein said traveling chassis comprises one of a hydraulic drive and a pneumatic drive.

14. An installation as set forth in claim 11, wherein said traveling chassis and said lifting fork extend from said telescopically extendable lifting tower in a substantially same direction for a substantially same distance.

15. An installation as set forth in claim 11, wherein said traveling chassis comprises a support roller located at an end of said traveling chassis that is remote from said telescopically extendable lifting tower.

16. An installation as set forth in claim 11, wherein said turning device has a height corresponding to a height of a base located below at least one parking space of a lowermost parking level of said at least two parking levels.

17. An installation as set forth in claim 11, wherein at least one of said parking spaces comprises cantilever arms operable to support a motor vehicle.

18. An installation as set forth in claim 11, wherein said lifting fork is operable to use channel-shape rails to transport the motor vehicles to said parking spaces and at least one of said parking spaces comprises shelf profile members operable to support the channel-shape rails and the motor vehicle.

19. An installation as set forth in claim 11, wherein said lifting fork is operable to use pallets to transport the motor vehicles to said parking spaces and at least one of said parking spaces comprises shelf profile members operable to support a pallet and the motor vehicle.

20. An installation as set forth in claim 11, wherein each of said at least two parking levels comprises a plurality of parking spaces arranged in a polygon around said telescopically extendable lifting device.

21. An installation for parking motor vehicles in a space-saving manner in parking spaces arranged one above another, said installation comprising:

a turning device comprising a turntable operable to rotate about an axis; and a lifting device moveably located on said turntable and operable to transport the motor vehicles to the parking spaces, said lifting device comprising:

a lifting tower, and a lifting fork moveably connected to said lifting tower, wherein said lifting fork is vertically displaceable along said lifting tower, and a traveling chassis connected in an asymmetrical arrangement to said lifting tower, said traveling chassis operable to move said lifting device horizontally, wherein said lifting device is rotatable about the axis via said turning device and is horizontally displaceable on said turntable via said traveling chassis.

* * * * *